United States Patent [19]

Krauss

[11] 4,184,774

[45] Jan. 22, 1980

[54] SILO FOR BULK MATERIAL

[75] Inventor: Werner Krauss, Hamburg, Fed. Rep. of Germany

[73] Assignee: Claudius Peters, AG., Hamburg, Fed. Rep. of Germany

[21] Appl. No.: 916,117

[22] Filed: Jun. 16, 1978

[30] Foreign Application Priority Data

Jun. 18, 1977 [DE] Fed. Rep. of Germany ..... 2727499

[51] Int. Cl.[2] ..... B01F 13/02

[52] U.S. Cl. ..... 366/107; 366/341; 366/143

[58] Field of Search ..... 366/341, 101, 106, 107, 366/143; 99/646 S; 222/193; 220/1 B

[56] References Cited

U.S. PATENT DOCUMENTS

| | | | |
|---|---|---|---|
| 2,723,838 | 11/1955 | Peters | 366/107 |
| 3,258,252 | 6/1966 | Lanier | 366/107 |
| 3,276,753 | 10/1966 | Solt | 366/107 |
| 3,648,985 | 3/1972 | Matweecha | 366/107 |
| 3,871,626 | 3/1975 | Wohlfarth | 366/107 |

*Primary Examiner*—Robert W. Jenkins

[57] ABSTRACT

An improved arrangement for controlling flow to the mixing or homogenizing chamber of a silo, in which inlet apertures are provided between the silo and the mixing chamber, includes a valve or gate member associated with each aperture and operable to control flow through the aperture. Inspection openings are also provided for inspecting the apertures.

5 Claims, 2 Drawing Figures

SILO FOR BULK MATERIAL

CROSS-REFERENCE TO A RELATED APPLICATION

Priority of corresponding German application No. P 27 27 499,3 filed June 18, 1977 is claimed under the Convention.

Copending U.S. applications Ser. Nos. 736,085, filed Oct. 27, 1976, 790,961, filed Apr. 2, 1977, and 844,440, filed Oct. 21, 1977 to the inventor Werner Krauss are made of record and their filing dates are claimed for all subject matters common herewith.

BACKGROUND OF THE INVENTION

1. Field of the Invention

The invention relates to a silo for bulk material, with a centrally arranged mixing and homogenizing chamber to which the bulk material is fed by ventilation of the silo base.

2. Description of the Prior Art

In known mixing silos, as seen, for example, in German Pat. Nos. 15 07 888, of Nov. 20, 1970, and in silos with a central homogenizing chamber, as seen, for example, in German patent applications Nos. P 26 57 596.2, filed Dec. 18, 1976, and P 26 57 597.3, filed Dec. 18, 1976, and in U.S. Pat. application Ser. No. 790,961, filed Apr. 26, 1977, the falling in or funneling in of bulk material into so-called mixing funnels takes place within the main silo space by the action produced by the ventilated silo base. In the centrally arranged chamber, this pre-mixing is followed by an intensive mixing or homogenization of the material. The feeding of the premixed bulk material into the central chamber takes place from the floor of the base of the main silo through apertures on the periphery of the chamber. By suitable ventilation control, and in dependency on the loosening pressure value of the bulk weight of the material and the prevailing flow performance or behavior of the bulk material between the main silo space and the central chamber, a so-called communicating effect is achieved which results in a specific filling level within the chamber.

As proved by experiences with a multiplicity of such mixing silos now in operation, very good operating results can be achieved by such a mixing apparatus. The compact structure, the low power requirements, and the elimination of otherwise customary intermediate transportations contribute further to the economic usefulness of such a device.

In order to obtain optimum operational results with respect to the mixing quality, however, it is necessary to carry out, prior to the construction of such a silo, as accurate as possible an adjustment between silo dimensioning, material passage, bulk weight, fineness of the bulk material, and the air containing capacity and flow performance thereof, especially of the powdered component, with the required pneumatic loosening systems. Once the silo and especially the chamber dimensions have been determined and the silo has been built according to these data, a subsequent correction of the flow-in levels for the chamber is only possible by means of control or selection of air distribution and pressure difference. This may be sufficient in some applications, but there are instances wherein such a belated correction by the aforementioned means is either impossible or incomplete. Further, there are cases wherein on account of the limitation of the capital investment required for the silo, or of changes in material passage or bulk conduct which may show up later, conditions occur that no longer permit an optimization of the mixing quality by means of ventilation control.

SUMMARY OF THE INVENTION

It is the purpose of the present invention to disclose a means in addition to, and independently of, such features as initial silo planning and construction and ventilation control, which permits the achievement of an optimum filling of the central chamber and thus an optimum mixing and homogenization effect. Moreover, the present invention accomplishes the result that with a bulk material that is introduced in a prepared state into the main silo space and is preliminarily mixed there by gravity mixing, partial quantities of this premixed bulk material can, as needed, be fed to the central chamber, whereafter additional components are added and the final mixing takes place in a known manner (German Pat. P 26 40 714.7). In order to make these charges within the central chamber uniform so as not to adulterate the formula prescribed, only a specific quantity of material is allowed to flow from the main silo space. However, shutting off the ventilation at the base of the main silo space, as is usually done in the prior art, is usually not sufficient to accomplish precise enough control of the flow of material.

Accordingly, in the present invention, a device is provided in association with the mixing or homogenizing chamber in a silo of the kind described above, to accomplish the aforementioned purposes. More particularly, a ring-shaped channel or manway is provided at a predetermined distance above the silo or chamber base, which presents at least one access opening or connection to the external wall of the silo. Furthermore, slide valves or gates are provided in association with the intakes of the mixing and homogenizing chamber, which can be operated from the ring-shaped channel, and passages in the ring-shaped channel for the slide valves or gates are constructed as inspection apertures.

By means of the slide valves or gates, which can be operated, as needed, from the ring-shaped channel, it is possible to change the diameter of, or shut off entirely, one or more intakes of the central chamber. Thus, a control of the material supply by mechanical means can be achieved in place of, or in addition to, a ventilation control acting upon the flow behavior. Therefore, it is possible with the present invention to carry out corrections with respect to the adjustment of silo dimensioning, material passage, bulk weight, etc., in a silo originally constructed for other data. Thus, corrections may be achieved with the present invention, which cannot be obtained by means of the penumatic loosening system alone.

Since the intakes of the chamber are located below the ring-shaped channel, it is also possible to inspect the chamber intakes from the ring-shaped channel. In large-space silos, which are constructed with 20,000 to 30,000 ton capacity and which, for reasons of economy, are constructed on undisturbed soil, and to this extent are provided with a lateral bulk material discharge only, the installation of a ring-shaped channel of the kind described is advantageous even for control functions. Naturally, in such silos it is not always possible to prevent the storage material, due to its characteristics or behavior, from undergoing variations in its sensitivity or, for instance, from forming lumps or clots when leaks occur in the silo ceiling area or on the silo wall, and thus moisture acts upon the storage material. Such agglomerations may impair the supply to the central chamber, with a correspondingly large enrichment of the mixture occurring. Such impediments in the material flow can be determined by means of the inspection apertures, and it is also possible to remove the impediments from the apertures without endangering personnel.

Preferably, both the ring-shaped channel and the central chamber are made of reinforced concrete, and the ring-shaped channel is arranged on the outside of the central chamber. However, the ring-shaped channel could equally as well be arranged on the inside of the central mixing or homogenizing chamber. Further, it is a matter of choice whether the ring-shaped channel is given one access only from the external silo wall, which access may be arranged beside the bulk material draining channel, or, a second access may be provided on the other side of the draining channel.

OBJECTS OF THE INVENTION

It is an object of the invention to provide a mechanical means which permits accurate adjustment of the flow or filling level of material in a mixing or homogenizing chamber of a silo.

Another object of the invention is to provide an economical silo and mixing chamber construction, which does not require close monitoring, and yet which enables optimum mixing to be accomplished.

A further object of the invention is to provide means for adjusting the flow and filling level of bulk material from a silo to a mixing and homogenization chamber in an existing silo construction, without relying solely on pneumatic conveying means.

A still further object of the invention is to provide a means for obtaining precise control of the filling level in a mixing or homogenizing chamber of a silo, to thereby obtain accurate control of the mixing of bulk material therein, wherein valve means are provided in association with flow apertures between the silo and mixing chamber.

Yet another object of the invention is to provide valve means for controlling the size of the openings between a silo and a mixing chamber, to thereby control the filling level of material in the mixing chamber, and wherein inspection openings are provided in association with the valve means, for inspecting the openings.

An even further object of the invention is to provide a manway around the mixing chamber in a silo, wherein apertures are provided between the silo and mixing chamber for flow of material from the silo into the mixing chamber, and valve means are associated with the apertures for controlling flow therethrough, the valve means being operable from the manway, and inspection openings being provided in association with the valve means for inspecting the apertures from the manway.

DETAILED DESCRIPTION OF THE PREFERRED EMBODIMENT

Figure 1:
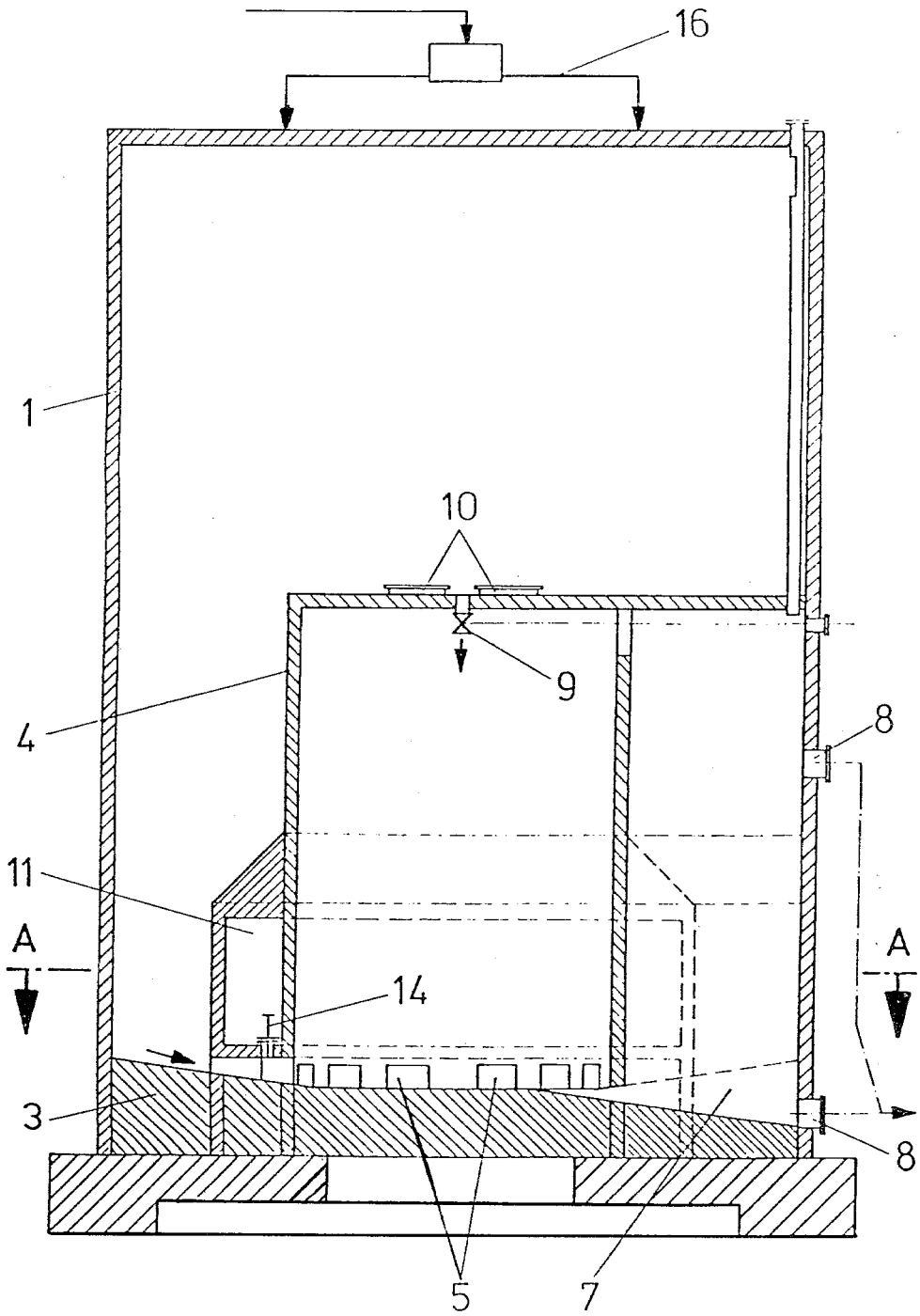
FIG. 1 shows a central vertical section through a silo embodying the invention.
Figure 2:
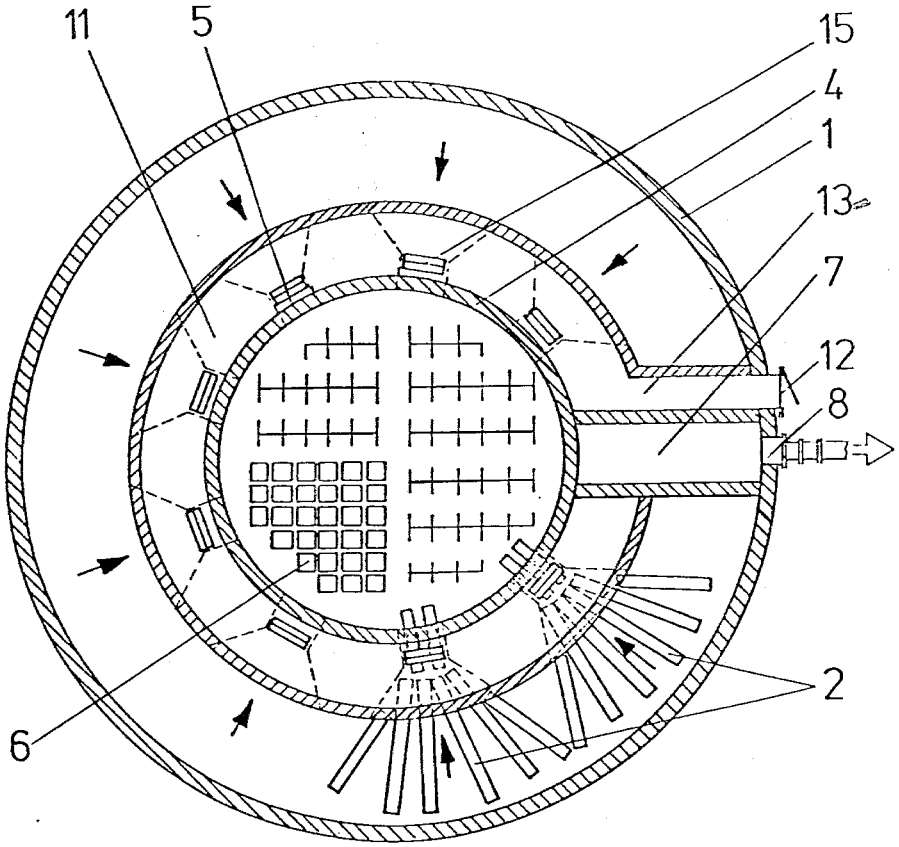
FIG. 2 shows a horizontal section through the silo along line A—A of FIG. 1.

Silo 1 is provided with a silo base 3 having ventilating elements, e.g. air conveyer chutes 2. In the center of the base of the silo there is a homogenization chamber 4, provided over its whole periphery adjacent the bottom thereof with intake apertures 5. The base of the chamber is equipped with ventilation plates 6, e.g., known porous ventilation stones.

A discharge chamber 7 adjoins laterally the central chamber, which discharge chamber is provided, at the external wall of the silo, with discharge apertures 8 at various levels.

In the embodiment shown, the ring-shaped channel or manway 11 of the invention is arranged at the outer surface of the cylindrical wall of the central chamber. The ring-shaped channel itself is passable or accessible to personnel and can be reached from the outside of the silo through a manhole or access 12 and an access channel or manway 13.

Each conically shaped intake of the central chamber can be partially blocked or choked or entirely shut off by means of a slide valve or gate 14, which can be actuated from the ring-shaped channel. The corresponding openings 15 on the base of the ring-shaped channel serve, on the one hand, to guide the slide, and on the other hand, as inspection apertures.

From the outside of the silo pipe line (not shown) may end in the upper space of the central chamber, through which pipe line the additional components can be directly introduced into the homogenization chamber.

An opening is provided in the ceiling of the homogenization chamber, and a slide 9 is positioned in the opening and may be operated by hand from the outside of the silo. Through this aperture, bulk material positioned above the chamber can be drawn off into the chamber by means of ventilation elements 10, while the slide 9 is open.

The filling of the main silo space takes place by means of a so-called bulk material distribution spider, indicated diagrammatically at 15.

The ring-shaped channel of the invention may, of course, also be arranged on top of a mixing chamber, in an arrangement as shown, for example in the German Pat. No. 1,507,888.

What is claimed is:

1. A silo for bulk material, with a centrally arranged mixing or homogenizing chamber comprising:

A. ventilation means to feed the bulk material by ventilation of the silo base;

B. a ring-shaped channel or manway provided in association with said mixing or homogenizing chamber at a predetermined distance above the silo or chamber base;

C. said manway having at least one passageway to the external wall of the silo;

D. intake openings provided from the silo to the mixing and homogenizing chamber;

E. valve means operable from the ring-shaped channel provided in association with the intake openings; and F. inspection openings provided in the manway for inspecting the intake openings.

2. In a silo for bulk material, as claimed in claim 1, wherein a mixing and homogenizing chamber is arranged within the silo and has flow passages therein for flow of the bulk material thereinto, and ventilation means for fluidizing the bulk material to cause it to flow into the mixing chamber;

said valve means being operatively associated with the flow passages for controlling the size of the opening therethrough to control flow of the bulk material into the mixing chamber.

3. A silo as claimed in claim 2, further comprising:

a manway extending around the mixing chamber adjacent the valve means, and inspection openings for inspecting the flow passages from the manway.

4. A silo as claimed in claim 3, said valve means comprising: slide valves, and means to operate the valve means from the manway.

5. A silo as claimed in claim 4, slide openings being provided in the manway for the slide valves, said slide openings comprising the inspection openings.

* * * * *